United States Patent [19]

Montgomery

[11] 4,333,386

[45] Jun. 8, 1982

[54] MECHANISM FOR SELECTIVELY ADJUSTING AMMUNITION FEED CHUTES

[75] Inventor: Donald N. Montgomery, Newport Beach, Calif.

[73] Assignee: The United States of America as represented by the Secretary of the Army, Washington, D.C.

[21] Appl. No.: 121,765

[22] Filed: Feb. 15, 1980

[51] Int. Cl.[3] ..... F41D 10/00

[52] U.S. Cl. ..... 89/33 SF

[58] Field of Search ..... 89/33 R, 33 A, 33 B, 89/33 BB, 33 BC, 33 SF

[56] References Cited

U.S. PATENT DOCUMENTS

| | | | |
|---|---|---|---|
| 1,698,228 | 1/1929 | Harring | 89/33 B |
| 3,440,926 | 4/1969 | Gura et al. | 89/33 SF |
| 3,455,204 | 7/1969 | Stoner | 89/33 SF |
| 3,512,449 | 5/1970 | Stoner | 89/169 |

*Primary Examiner*—Harold J. Tudor

*Attorney, Agent, or Firm*—Peter A. Taucher; John E. McRae; Nathan Edelberg

[57] ABSTRACT

In association with a rapid-fire gun, a power-operated mechanism for adjusting two ammunition supply chutes in positions to selectively feed ammunition to the gun. One chute feeds one type of ammunition, and the other chute feeds a different type of ammunition. The power-operated mechanism can be remotely controlled from a protected location within a military vehicle.

6 Claims, 7 Drawing Figures

MECHANISM FOR SELECTIVELY ADJUSTING AMMUNITION FEED CHUTES

The invention described herein may be manufactured, used, and licensed by or for the Government for governmental purposes without payment to me of any royalty thereon.

BACKGROUND AND SUMMARY OF THE INVENTION

U.S. Pat. No. 3,440,926 issued to R. J. Gura, et al on Apr. 29, 1969 discloses a power mechanism for adjusting two ammunition feeder chutes between feeding and nonfeeding positions. The present invention is directed to an alternate power mechanism for accomplishing this purpose. The mechanism is designed for convenient disconnection from the feeds chutes, to permit either chute to be operated manually, e.g. on failure of the power mechanism.

THE DRAWINGS

Figure 3:
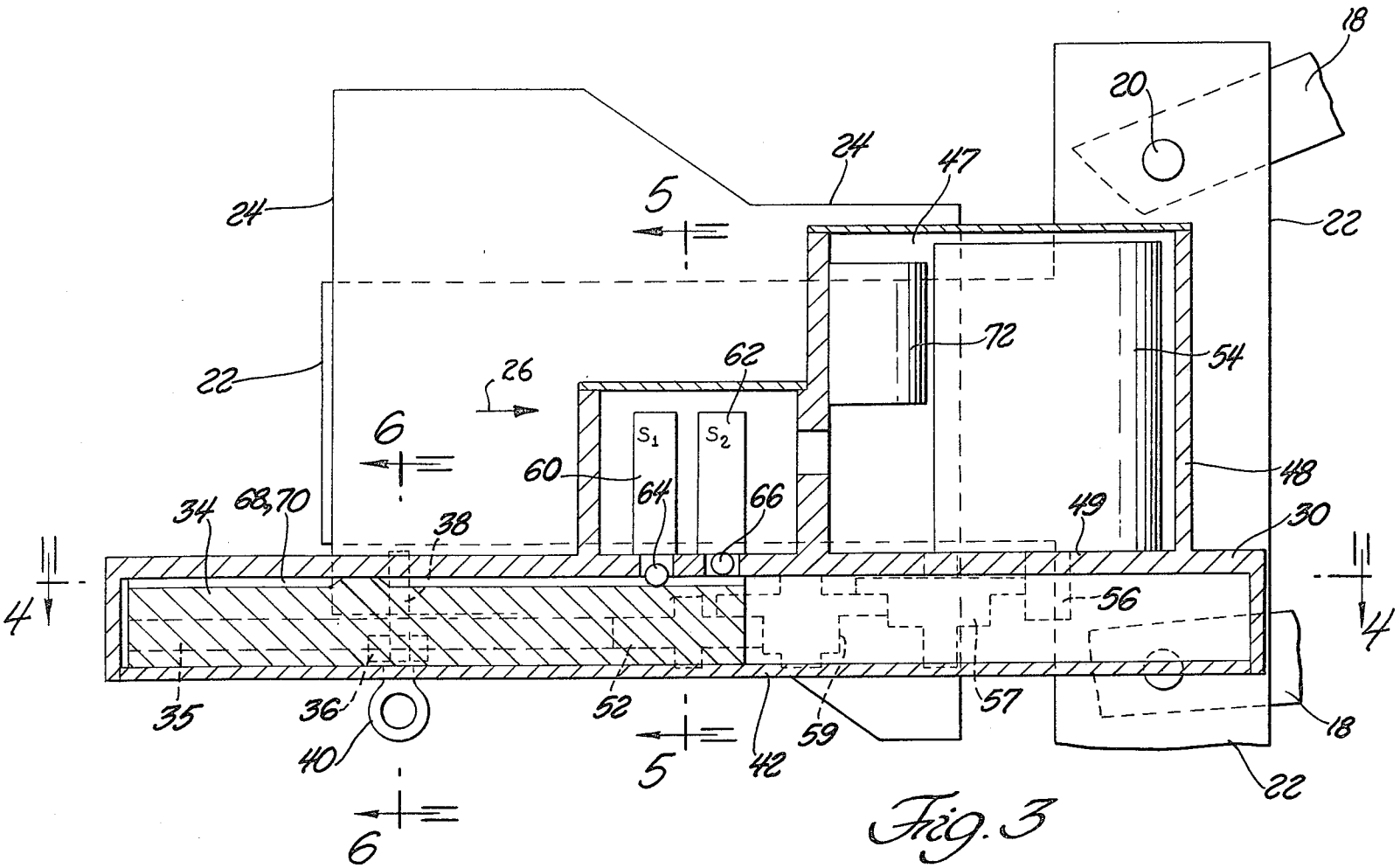
FIG. 3 is a fragmentary view of the FIG. 1 mechanism equipped with a power-operated device of the present invention.
Figure 4:
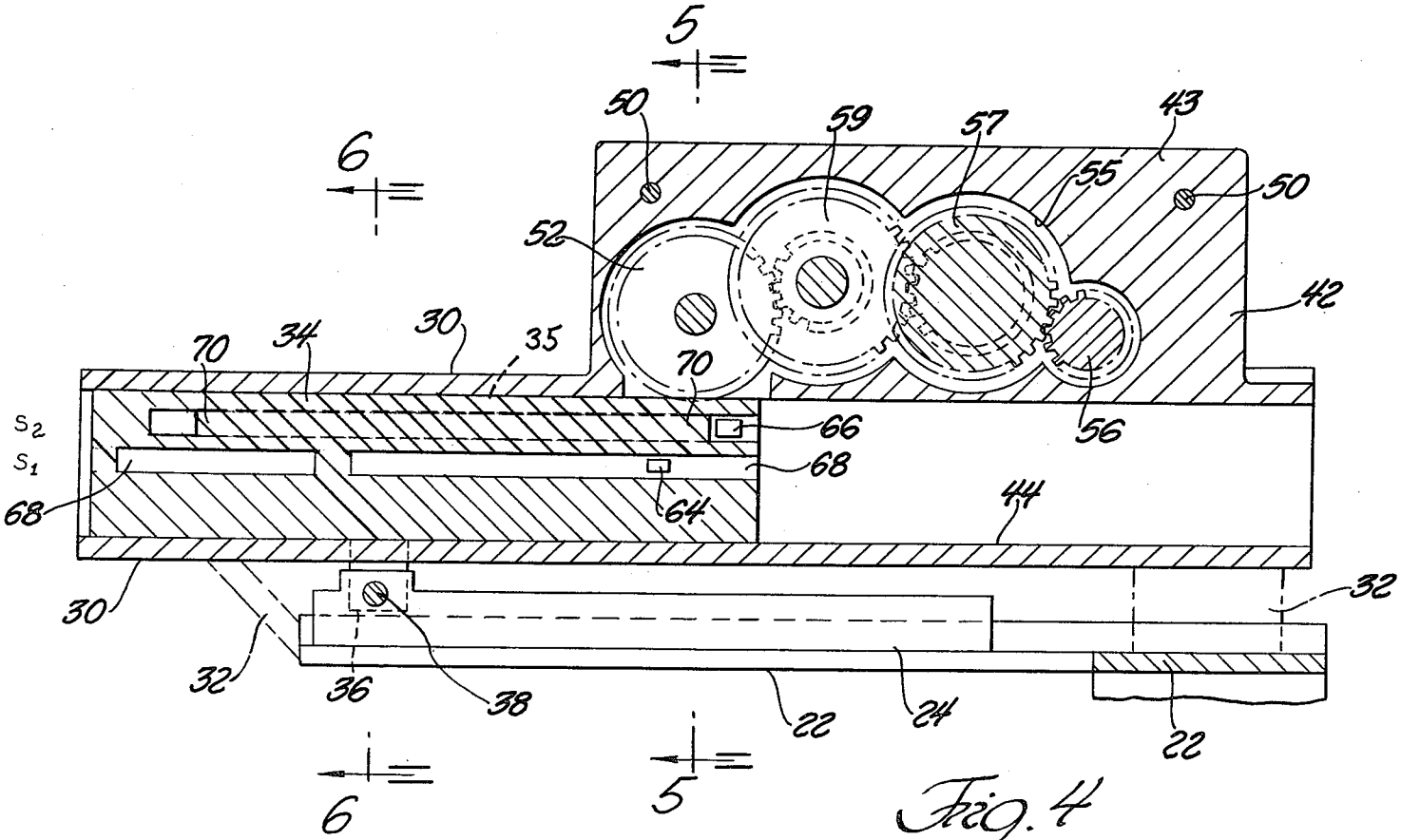
Figure 5:
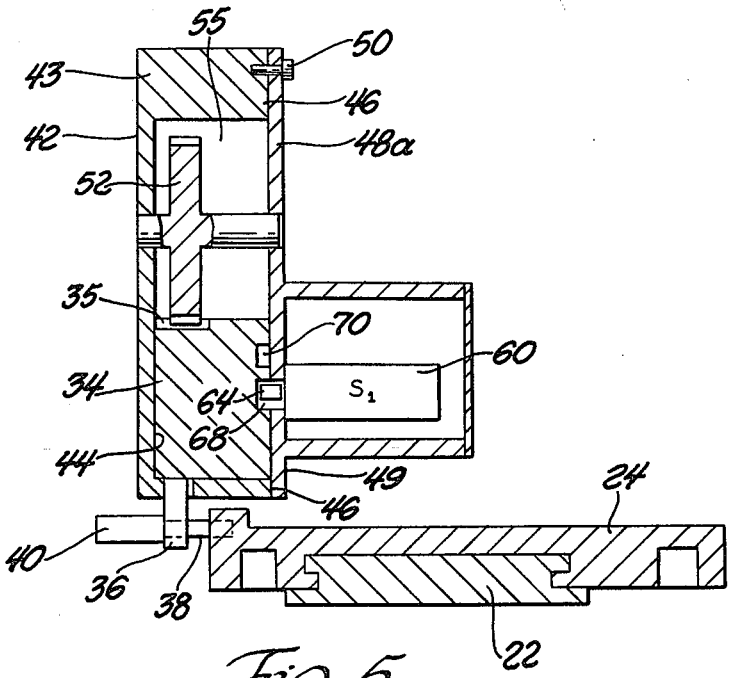
Figure 6:
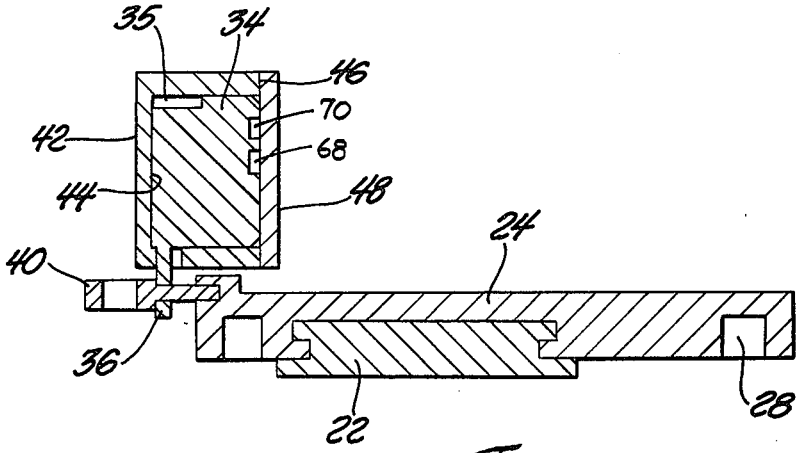

FIGS. 4, 5 and 6 are sectional views on line 4—4, 5—5 and 6—6 in FIG. 3.

Figure 7:
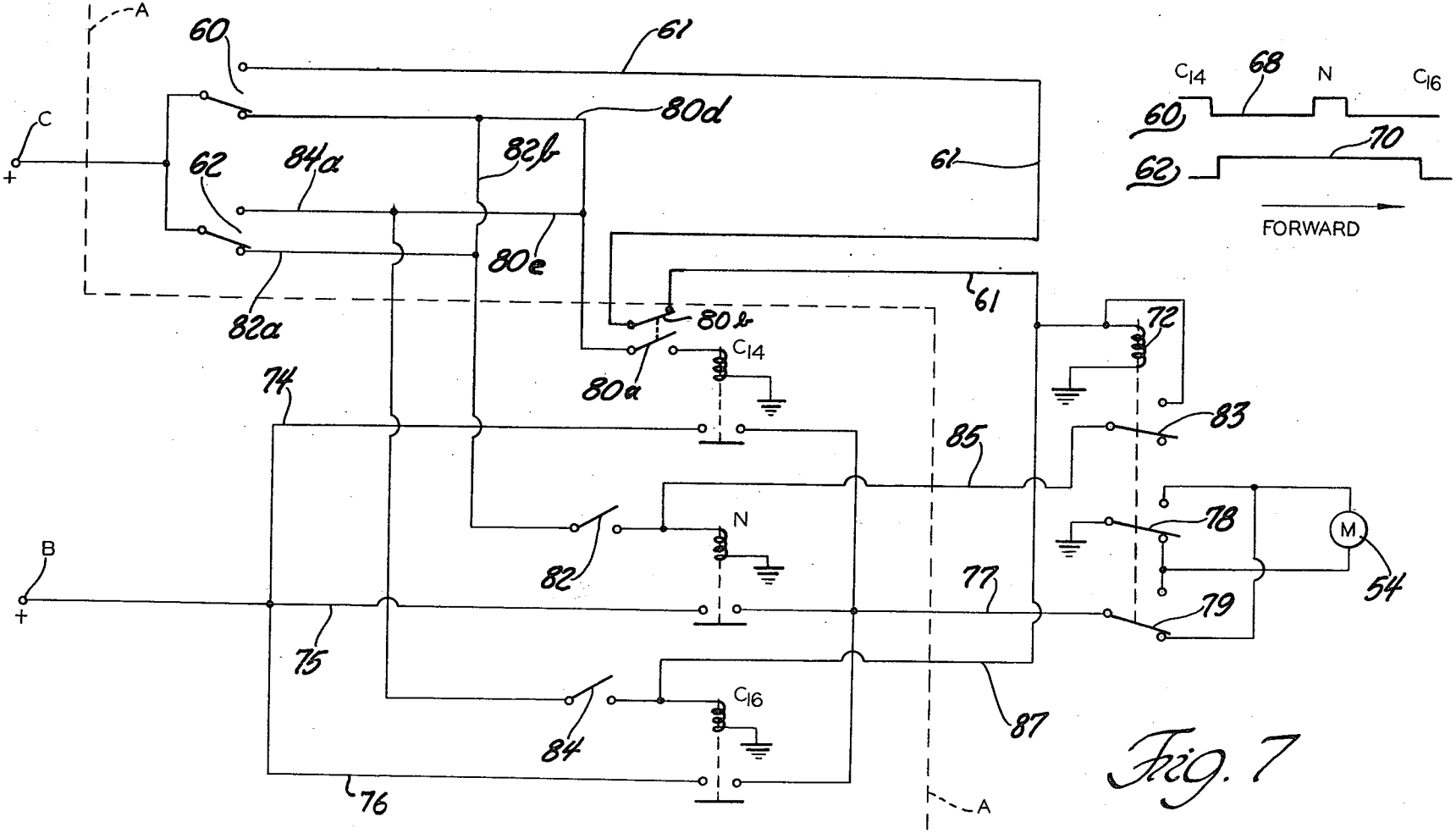

FIG. 7 is a schematic illustration of electric circuitry for controlling the FIG. 3 device.

Figure 1:
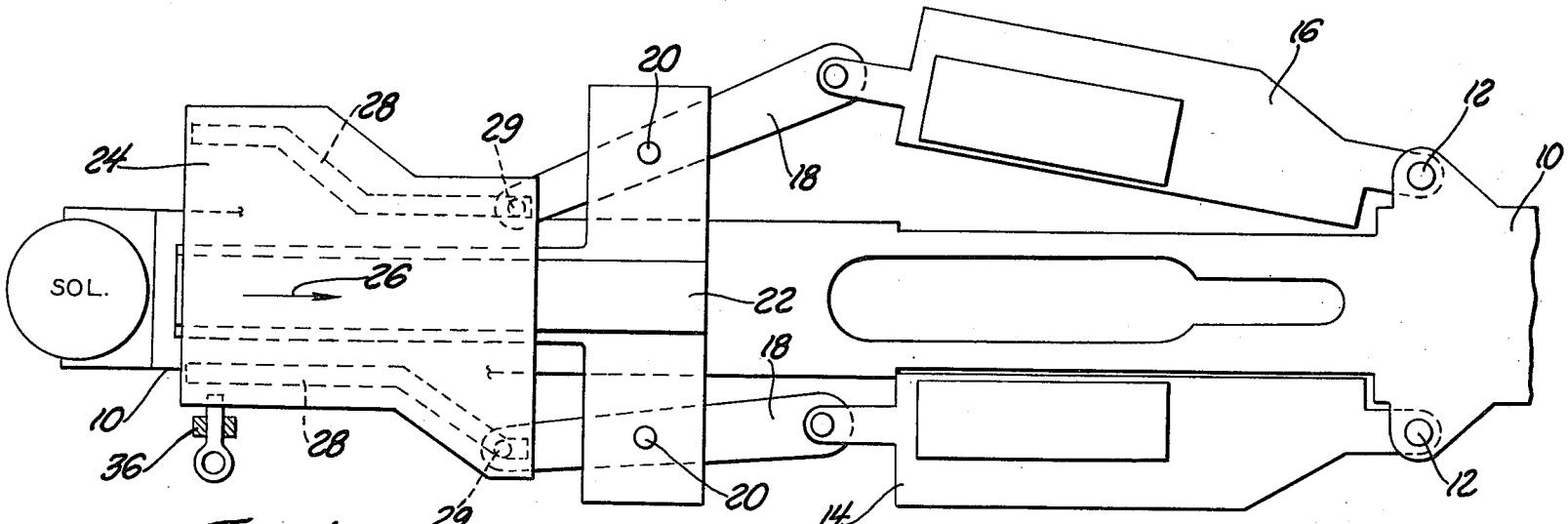
FIG. 1 is a top plan view of a gun having an already-known mechanism for shifting ammunition chutes between feed and nonfeed positions.
Figure 2:
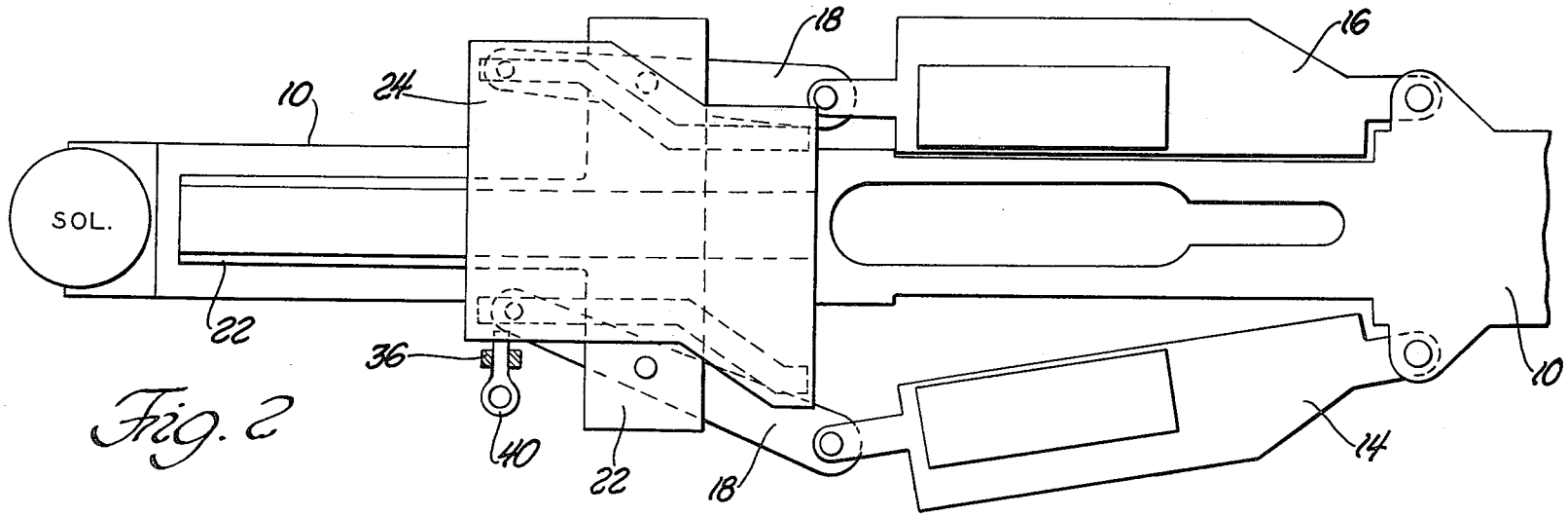
FIG. 2 is similar to FIG. 1 except that it shows the mechanism in a second adjusted position.

Referring in greater detail to FIGS. 1 and 2, there is fragmentarily shown a gas-operated gun of the type more completely described and illustrated in U.S. Pat. No. 3,512,449 issued to E. M. Stoner on May 19, 1970. The illustrated gun includes a receiver 10 having pivotal connections 12 with ammunition feeder chutes 14 and 16. Each feeder chute is connected to a link 18 that is pivotally mounted at 20 on a T-shaped guide element 22 bolted or otherwise affixed to receiver 10. Element 22 slidably supports a chute actuator plate 24 for movement parallel to the gun axis, as denoted by numeral 26 in FIG. 1. Plate 24 is provided on its undersurface with two cam grooves 28 which accommodate rollers 29 carried by the free ends of links 18. In the FIG. 1 position plate 24 is located so that chute 14 is engaged with the receiver 10 for feeding ammunition to the gun, as described generally in aforementioned U.S. Pat. No. 3,512,449; chute 16 is spaced from the receiver in a standby or nonfeed position. Movement of plate 24 to the FIG. 2 position causes chute 14 to move to the nonfeed position and chute 16 to move to the feed position. In an intermediate neutral position, not shown, plate 24 holds both chutes in nonfeed positions.

Under conventional practice plate 24 is operated between the FIG. 1 and FIG. 2 positions by a handle attached directly to plate 24. The present invention is directed to a motor-operated mechanism for moving the plate without direct manual actuation. The mechanism is especially intended for use when the gun is positioned externally atop the turret of a military vehicle, and the gun is to be controlled from within the vehicle without direct human actuation of the ammunition feeder chutes. The mechanism of my invention is illustratively shown in FIGS. 3 through 6 of the drawings, with certain details omitted due to the drawing scale.

The mechanism includes a toothed rack 34 having a pin 38 disengageably connected with plate 24. A motor-speed reducer assembly is provided to move the rack in a fore-aft direction parallel to direction line 26 (FIG. 1). The rack has two cam tracks 68 and 70 on its side surface for movement across roller actuators of limit switches 60 and 62. The switches are electrically connected into a control system which disengages the rack motor at three discrete locations, defined as the chute 14 feed position C14 (FIG. 1), the neutral no-feed position N, and the chute 16 feed position C16 (FIG. 2). A manually-operated selector switching system in the vehicle starts the rack-operating motor into operation.

FIG. 3 shows rack 34 slidably disposed within a stationary slideway 30 attached to guide element 22 by suitable brackets 32 (FIG. 4). Rack 34 carries an arm 36 that depends through a slot in slideway 30 for reception of a pin 38 that is equipped with an enlarged head 40 having a circular hole sized to fit a person's finger. The pin fits into a bore in the side surface of plate 24 to form a disengageable connection between the plate and rack 34.

Slideway 30 is defined by two housing elements 42 and 48 bolted together to slidably guide and enclose rack 34. Housing element 42 is a block-like member having a rectangular groove 44 machined into its side 46 to fit around three faces of rack 34. The second housing element 48 is positioned flatwise against face 46 of housing element 42 to engage the fourth face of rack 34. The rack has teeth 35 extending along its upper face for the full length of the rack. Housing element 42 includes an upwardly-projecting section 43 (FIG. 4) that defines circular cavities 55 for housing a system of speed reducer pinion gears, designated by numerals 52, 59 and 57. Housing element 48 includes a plate-like extension 48*a* (FIG. 5) arranged to close the cavities defined by housing section 43; screws 50 are provided for securing the two housing elements together.

The prime mover force for driving gear 52 is a reversible electric motor 54 shown in FIG. 3. Motor 54 is mounted within a chamber 47 in the second housing element 48 so that its drive shaft 56 extends into one of the circular cavities 55 in housing element 42. The circular cavities are bored in the face of housing element 42 to receive gears 56, 57, 59 and 52. The shafts for these various gears are conjointly supported by the two housing elements 42 and 48.

It will be remembered that chute actuator plate 24 is designed to have three different positions, namely the FIG. 1 position in which chute 14 feeds ammunition to the gun, the FIG. 2 position in which chute 16 feeds ammunition of the gun, and an intermediate neutral position in which both chutes are in nonfeed conditions. To enable plate 24 to have these three positions I provide a system of motor limit control switches. These switches, numbered 60 and 62 are provided with roller actuators 64 and 66, each actuator engaging a control track 68 or 70 machined into a side surface of rack 34. As the motor 54 is energized to move rack 34 along slideway 30 the roller actuators 64 and 66 will operate limit switches 60 and 62 to discontinue energization of motor 54 when rack 34 reaches the desired position corresponding to a selected setting of plate 24.

FIG. 7 illustrates an electric circuit for controlling motor 54. The components to the right of dashed line A are located on the gun; the components to the left of dashed line A are located in the vehicle. Voltage for driving motor 54 is delivered from positive source B through three parallel lines 74, 75 and 76 individually controlled by relays C14, N, and C16. A relay coil 72 controls two sets of contacts 78 and 79, which determine the rotational direction of motor 54. A third set of relay contacts 83 holds coil 72 energized under certain conditions. In the energized condition of coil 72 contacts 78 and 79 are switched so that motor 54 is driven in the forward direction, i.e. toward a condition wherein rack 34 is at location C16. In the de-energized condition of coil 72, contacts 78 and 79 occupy the illustrated position for causing motor 54 to move in a reverse direction, i.e. toward a condition wherein rack 34 is at location C14.

Individual relays C14, N and C16 are controlled by manual switches 80, 82 and 84 located in individual control lines that lead from voltage control source C through limit switches 60 and 62. Switch 80 is a two pole switch comprised of two switch elements 80*a* and 80*b*. Only one of switches 80, 82 and 84 can be closed at any one time. The small chart in the upper right corner of FIG. 7 illustrates the conditions of the limit switch contacts at the three ammunition chute positions C14, N and C16.

Depression of switch elements 80 and 80*b* energizes relay C14 through line 80*d* or 80*e*, depending on whether rack 34 is initially at position C16 or N. Current is delivered through line 74 to main motor energizer line 77. Switch element 80*b* opens line 61 so that coil 72 is in a de-energized state; contacts 78 and 79 are in the illustrated reverse-motion positions When limit switch 62 disconnects current flow through line 80 then relay coil C14 is de-energized; rack 34 is then at position C14.

Closure of switch 82 energizes relay N as long as limit switches 60 and 62 supply current through lines 82*b* or 82*a*. Motor 54 is energized by current flow through lines 75 and 77 until relay N no longer receives control current through line 82*a* or 82*b*; at that point in time rack 34 is at position N. If at the time switch 82 is initially closed, rack 34 is at position C14, then coil 72 will be energized through a circuit that includes the upper contact of switch 60 and line 61. Coil 72 then moves contacts 78 and 79 to the positions wherein motor 54 operates in the forward direction. Coil 72 also moves contacts 83 to a position closing a coil-holding circuit 85; when switch 60 opens the circuit through line 61 the relay coil 72 will continue to receive current through line 85. Switches 60 and 62 de-energize relay N to locate rack 34 at position N.

Closure of manual switch 84 energizes relay coil C16 as long as limit switches 60 and 62 supply current to lines 84*a* or 61; line 76 energizes motor 54 through line 77 and the two switches 79 and 78. When neither of lines 84*a* or 61 receives current then coil C16 opens to interrupt current flow through line 76 to the motor. This occurs when rack 34 is at position C16. Relay coil 72 is maintained in the motor-forward condition by current flow through line 87.

The above-described circuit is merely illustrative of circuits that can be used to control motor 54. Other circuits using electronic logic devices are feasible. The invention is concerned principally with the hardware construction shown in FIGS. 3 through 6. The construction is advantageous in such respects as relatively small size, a measure of ballistic protection for the electrical components or gearing, and capability for easy disconnection from actuator plate 24.

I wish it to be understood that I do not desire to be limited to the exact details of construction shown and described for obvious modifications will occur to a person skilled in the art.

I claim:

1. In a gun having a receiver, first and second ammunition feed chutes, each movably mounted between a standby position spaced from the receiver and a feeder position engaged with the receiver, and a chute actuator plate (24) movable in the direction of the gun axis from a first rearward position in which only one chute is set to feed ammunition to a second intermediate position in which neither chute can feed ammunition, to a third forward position in which only the other chute is set to feed ammunition; the improvement comprising electrically-energized powered mechanism for moving the chute actuator plate to its three positions, said mechanism including a slideway (30) oriented parallel to the direction of motion of the chute actuator plate, a toothed rack (34) slidably mounted in the slideway and having a disengageable connection (38) with the chute actuator plate, a rotary pinion gear (52) stationed at a point along the slideway to move the rack, a reversible electric motor (54) drivingly connected to the pinion gear, first and second motor limit switches (60, 62) located at the slideway, each switch having a depressable actuator; said rack having first and second control tracks (68, 70) on its side surface individually engaged by respective ones of the switch actuators, the tracks being contoured to provide three different switch condition combinations for selectively de-energizing the motor when the chute actuator plate reaches its three aforementioned positions.

2. The improvement of claim 1 and further comprising a speed reduction gear means between the motor and the pinion gear.

3. The improvement of claim 2 wherein the rack has a rectangular cross section, the rack teeth and control tracks being formed in adjacent faces of the rack.

4. The improvement of claim 3 wherein the slideway is defined by first and second housing elements (42, 48) said first housing element being a block-like member having a longitudinal groove (44) in one of its faces to slidably engage three faces of the rack, the second housing element being bolted onto said one face of the first housing element for enclosing the rack within the longitudinal groove.

5. An improvement of claim 4 wherein the motor limit switches are positioned in the second housing element, each switch having its actuator extending through a wall of the second housing element into a control track on the side surface of the aforementioned rack.

6. An improvement of claim 5 wherein the first housing element includes a cavity (55) separate from the aforementioned groove, the motor being mounted in the second housing element and having a drive gear (56) projecting into the cavity, the aforementioned pinion gear being disposed in the cavity remote from the drive gear, and a system of speed reducer gears physically located in the cavity in operative driving connection between the drive gear and pinion gear, the above-mentioned gears having shaft sections jointly supported by the first and second housing elements.

* * * * *